US011772106B2

(12) United States Patent
Vinci et al.

(10) Patent No.: US 11,772,106 B2
(45) Date of Patent: Oct. 3, 2023

(54) VENTED NOZZLE FOR AIR BLOW GUN

(71) Applicants: Ian R. Vinci, Shandaken, NY (US); Peter R. Vinci, Shandaken, NY (US); Peter Vinci, Shandaken, NY (US)

(72) Inventors: Ian R. Vinci, Shandaken, NY (US); Peter R. Vinci, Shandaken, NY (US); Peter Vinci, Shandaken, NY (US)

( * ) Notice: Subject to any disclaimer, the term of this patent is extended or adjusted under 35 U.S.C. 154(b) by 198 days.

(21) Appl. No.: 17/448,165

(22) Filed: Sep. 20, 2021

(65) Prior Publication Data

US 2022/0088618 A1 Mar. 24, 2022

Related U.S. Application Data

(60) Provisional application No. 63/198,013, filed on Sep. 24, 2020.

(51) Int. Cl.

| | |
|---|---|
| ***F02B 77/04*** | (2006.01) |
| ***B05B 1/14*** | (2006.01) |
| ***B08B 9/032*** | (2006.01) |

(52) U.S. Cl.

CPC ..... *B05B 1/14* (2013.01); *B08B 9/0328* (2013.01); *B08B 2209/032* (2013.01); *F02B 77/04* (2013.01)

(58) Field of Classification Search

CPC ..... F02B 77/04; F26B 21/004; F05B 1/14; F05B 1/005; B08B 9/0328; B08B 2209/032; B08B 5/02; B05B 13/0627

USPC ..... 123/65 BA; 239/590

See application file for complete search history.

(56) References Cited

U.S. PATENT DOCUMENTS 10,914,205 B2 * 2/2021 Gurler ..... F02B 25/18

FOREIGN PATENT DOCUMENTS

| | | | | |
|---|---|---|---|---|
| CN | 204716491 | * | 10/2015 | |
| CN | 204716492 | * | 10/2015 | |
| JP | S62144590 | * | 9/1987 | ..... B08B 5/04 |
| JP | H0224536 | * | 7/1990 | ..... B22D 29/00 |

* cited by examiner

*Primary Examiner* — Hai H Huynh

(74) *Attorney, Agent, or Firm* — LAW OFFICES OF MICHAEL L. WISE, LLC

(57) ABSTRACT

An attachment for an air blow gun includes a nozzle and a nozzle insert. The nozzle is a hollow cylinder and includes radial pinholes at one end. The nozzle insert includes a longitudinal pinhole. The nozzle insert is inserted into the end of the nozzle with the radial pinholes. When high-pressure air is delivered to the attachment, plumes of high-velocity air exit from the radial pinholes and the longitudinal pinhole. The attachment is particularly well suited to cleaning confined spaces in workpieces with high-velocity air.

19 Claims, 3 Drawing Sheets

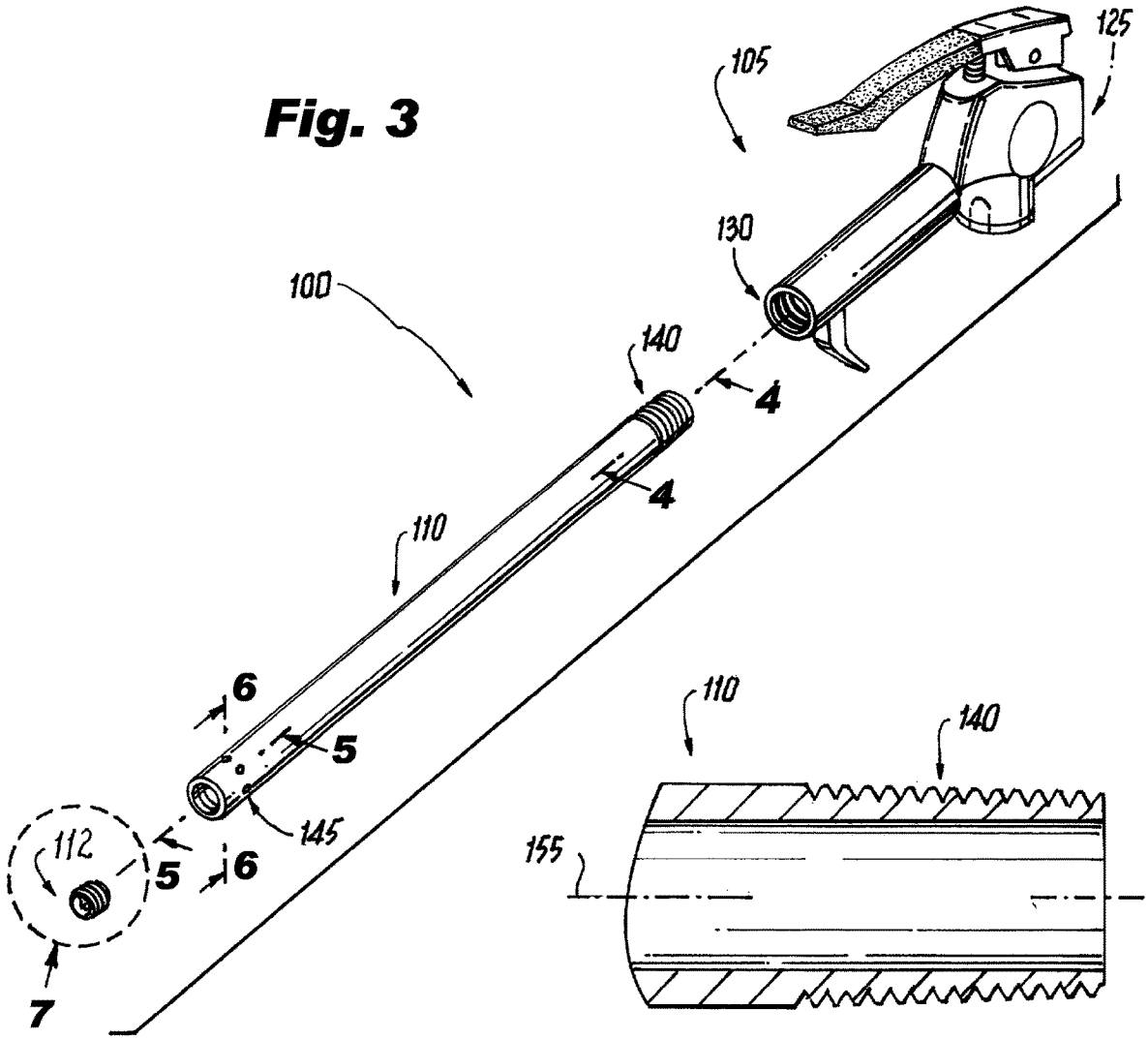
Fig. 3
Fig. 4
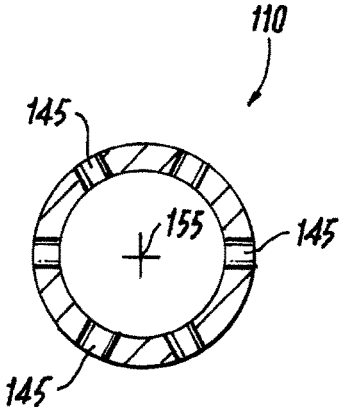
Fig. 6
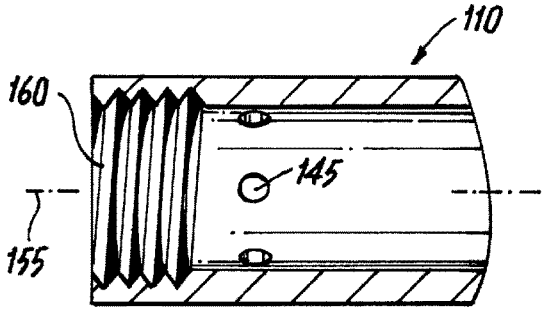
Fig. 5

VENTED NOZZLE FOR AIR BLOW GUN

FIELD OF THE INVENTION

The present invention relates generally to apparatus for cleaning, and, more particularly, to apparatus for cleaning via the use of air flow.

BACKGROUND OF THE INVENTION

High-velocity air is often used to blow debris from a workpiece or to dry the workpiece. One way this is accomplished is to use an air blow gun. The air blow gun receives high-pressure air from a high-pressure air line. A trigger or lever on the air blow gun allows the user to modulate the amount of high-velocity air that is delivered to the workpiece.

Several nozzles are available for air blow guns that help to direct the flow of air from the air blow gun in the manner desired. There remains a need, however, for a nozzle that is ideal for cleaning confined spaces in workpieces such as internal combustion engines and the like.

SUMMARY OF THE INVENTION

Embodiments of the present invention address the above-identified needs by providing air blow gun nozzles that are well suited for cleaning with high-velocity air.

Aspects of the invention are directed to an apparatus comprising a nozzle and a nozzle insert. The nozzle is hollow cylindrical, centered about a central longitudinal nozzle axis, defines distal internal threads proximate to a distal end of the nozzle, and defines a plurality of radial pinholes proximate to the distal end and directed radially to the central longitudinal nozzle axis. The nozzle insert is cylindrical, centered about a central longitudinal insert axis, defines insert external threads, and defines a longitudinal pinhole along the central longitudinal insert axis. The nozzle insert is fixedly inserted into the distal end of the nozzle with the insert external threads threadably engaging the distal internal threads.

Additional aspects of the invention are directed to an air blow gun, a nozzle attached to the air blow gun, and a nozzle insert. The nozzle is hollow cylindrical, centered about a central longitudinal nozzle axis, defines distal internal threads proximate to a distal end of the nozzle, and defines a plurality of radial pinholes proximate to the distal end and directed radially to the central longitudinal nozzle axis. The nozzle insert is cylindrical, centered about a central longitudinal insert axis, defines insert external threads, and defines a longitudinal pinhole along the central longitudinal insert axis. The nozzle insert is fixedly inserted into the distal end of the nozzle with the insert external threads threadably engaging the distal internal threads.

In embodiments of the invention, high-pressure air is sent to the nozzle and to the nozzle insert via the air blow gun. The high-pressure air exits the apparatus as high-velocity plumes of air from the plurality of radial pinholes and the longitudinal pinhole. The high-velocity plumes of air allow a user to easily clean confined spaces in a workpiece.

BRIEF DESCRIPTION OF THE DRAWINGS

Features, aspects, and advantages of the present invention will become better understood with regard to the following description and accompanying drawings where:

FIG. 3 shows an exploded perspective view of the FIG. 1 apparatus;

FIG. 4 shows a sectional view of a proximal end of the nozzle in the FIG. 1 apparatus along the cleave plane indicated in FIG. 3;

FIG. 5 shows a sectional view of the distal end of the nozzle in the FIG. 1 apparatus along the cleave plane indicated in FIG. 3;

FIG. 6 shows a sectional view of a distal end of the nozzle in the FIG. 1 apparatus along the cleave plane indicated in FIG. 3;

DETAILED DESCRIPTION OF THE INVENTION

The present invention will be described with reference to illustrative embodiments. For this reason, numerous modifications can be made to these embodiments and the results will still come within the scope of the invention. No limitations with respect to the specific embodiments described herein are intended or should be inferred.

As used herein and in the appended claims, one element is "substantially normal" to another if they form an angle between 80 and 100 degrees. For an object with a length, L, between two opposite ends, an element is "proximate to" a specified end of the object if at least some of the element is less than a distance of twenty-percent-of-L from the specified end of the object.

Figure 1:
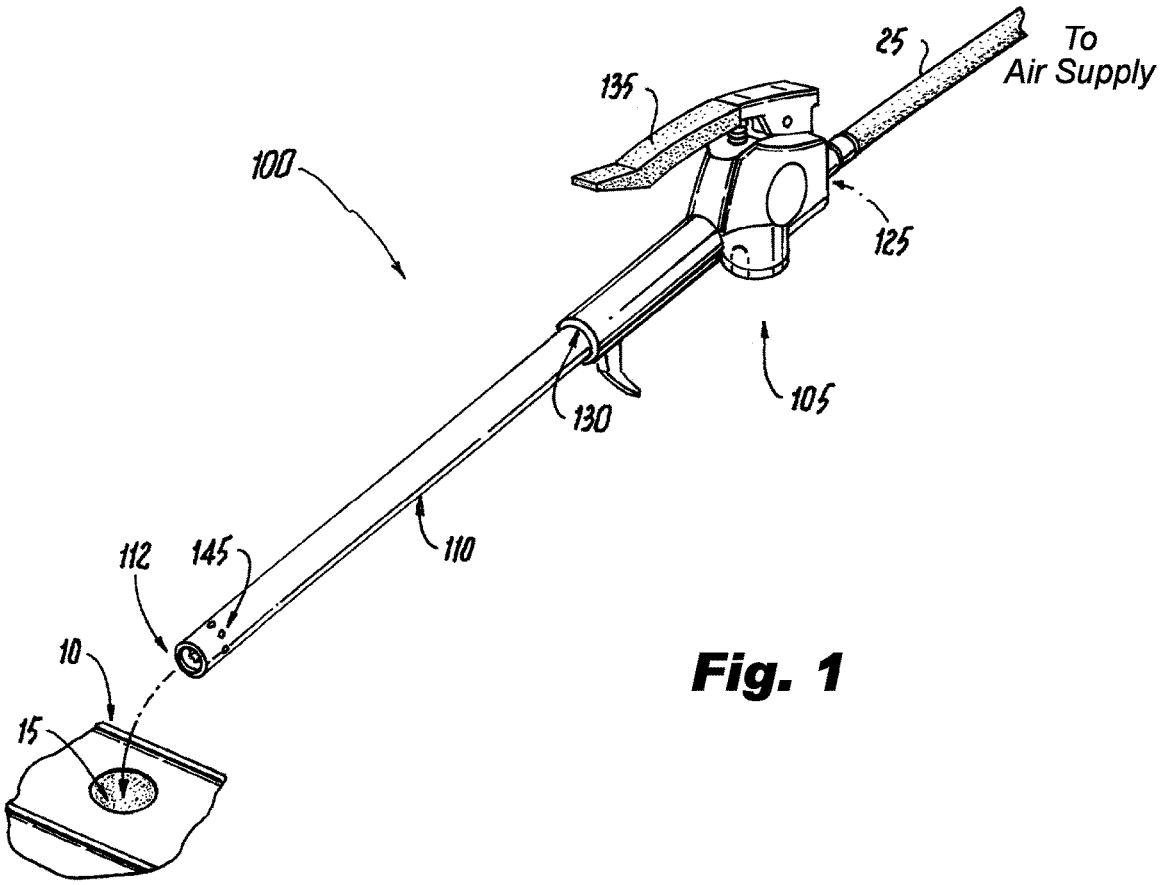
FIG. 1 shows a perspective view of an apparatus in accordance with an illustrative embodiment of the invention in association with a workpiece.

FIG. 1 shows a perspective view of an apparatus 100 in accordance with an illustrative embodiment of the invention in association with a workpiece 10. The workpiece 10 defines a confined space 15 (e.g., hole in the workpiece 10) to be cleaned or dried by high-velocity air from the apparatus 100. The apparatus 100 comprises an air blow gun 105 and a nozzle 110 that terminates in a nozzle insert 112. The air blow gun 105 includes an air input port 125 attached to a high-pressure air line 25 at one end, and an output port 130 attached to the nozzle 110 at the opposite end. A lever 135 is operative to modulate the amount of high-pressure air passing through the air blow gun 105 from the air input port 125 to the output port 130. The lever 135 may be readily operated by a user grasping the air blow gun 105.

Figure 2:
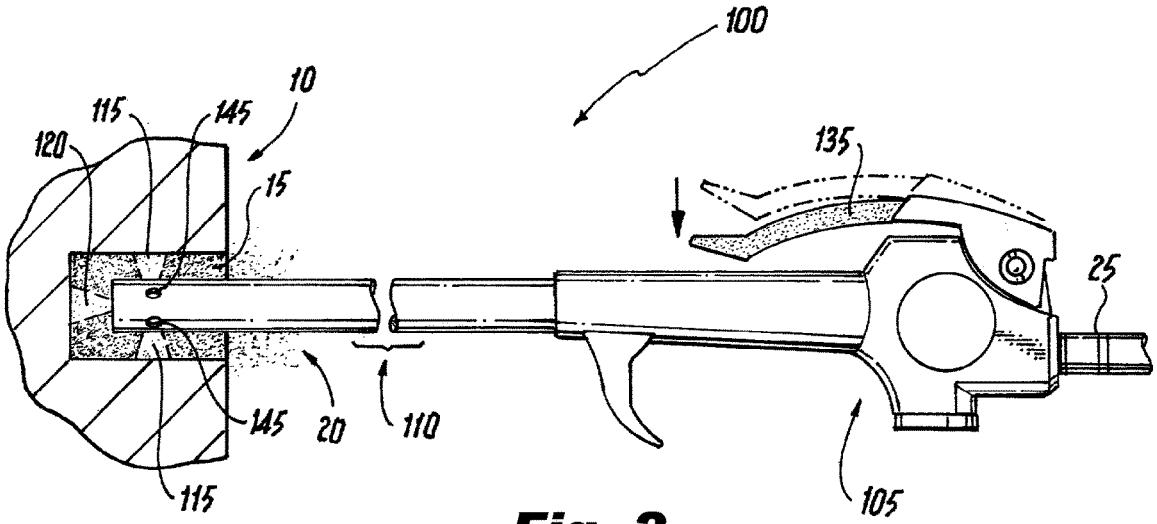
FIG. 2 shows a partially-broken side view of the FIG. 1 apparatus and workpiece with the nozzle inserted into the workpiece.

In use, high-pressure air may be routed to the air blow gun 105 from, for example, an air compressor. The air blow gun 105 may then be used to send the high-pressure air through the nozzle 110 and the nozzle insert 112 into the workpiece 10. FIG. 2 shows a partially-broken side view of the apparatus 100 and workpiece 10 with the nozzle 110 and the nozzle insert 112 inserted into the confined space 15. The apparatus 100 provides seven plumes of high-velocity air: six radial plumes 115 and a longitudinal plume 120. The six radial plumes 115 exit the apparatus 100 in a direction substantially normal to the direction that the longitudinal plume 120 leaves the apparatus 100. The plumes 115, 120 are directed into the workpiece 10 and dislodge debris 20 therefrom.

Additional aspects of the apparatus 100 are shown in FIGS. 3-6, with FIG. 3 showing an exploded perspective view of the apparatus 100, FIG. 4 showing a sectional view of a proximal end of the nozzle 110 along the cleave plane indicated in FIG. 3, FIG. 5 showing a sectional view of the distal end of the nozzle 110 along the cleave plane indicated in FIG. 3, and FIG. 6 showing a sectional view of a distal end of the nozzle 110 along the cleave plane indicated in FIG. 3. The nozzle 110 is hollow cylindrical and defines proximal external threads 140 at its proximal end. These proximal external threads 140 are sized so as to be threadable into the output port 130 of the air blow gun 105, which is internally-threaded. The nozzle 110 defines six radial pinholes 145 near its distal end opposite the proximal external threads 140. The six radial pinholes 145 are evenly spaced and are directed radially to a central longitudinal nozzle axis 155, about which the nozzle 110 is centered. The nozzle 110 also defines distal internal threads 160 near its distal end.

Figure 7:
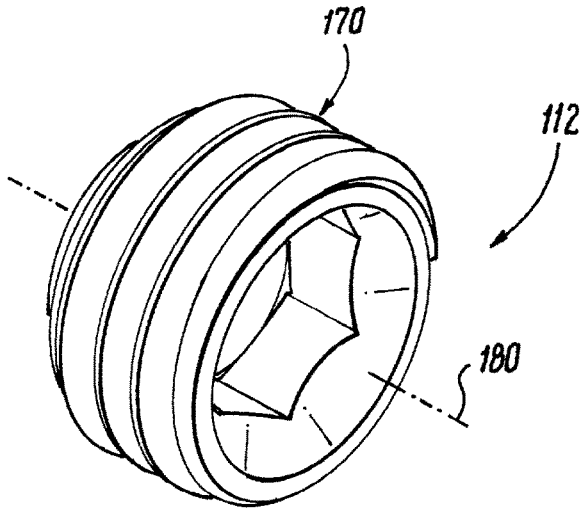
FIG. 7 shows a perspective view of the nozzle insert in the FIG. 1 apparatus.
Figure 8:
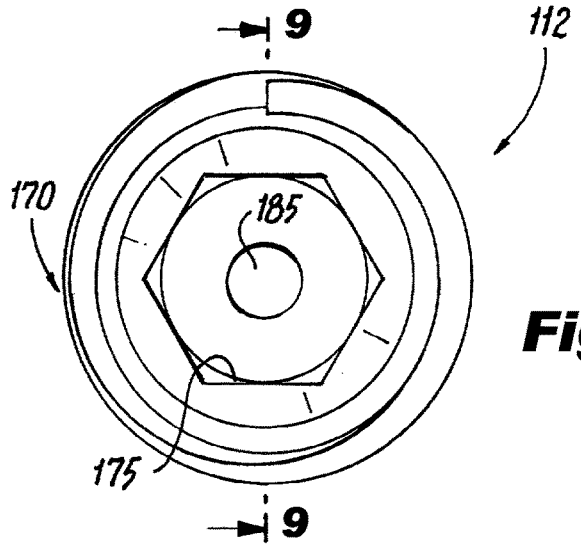
FIG. 8 shows an end view of the nozzle insert in the FIG. 1 apparatus.
Figure 9:
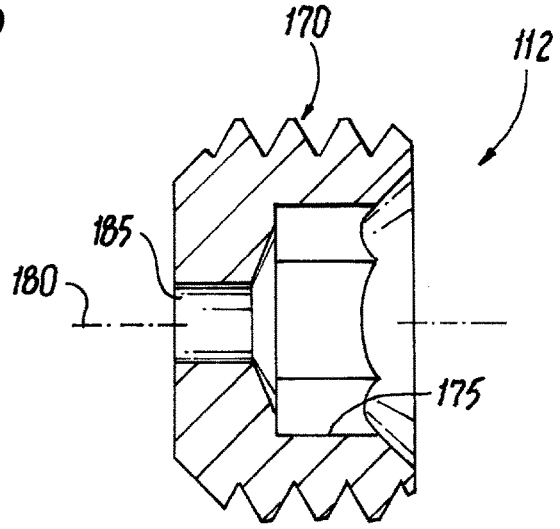
FIG. 9 shows a sectional view of the nozzle insert in the FIG. 1 apparatus along the cleave plane indicated in FIG. 8.

The distal internal threads 160 of the nozzle 110 accommodate the nozzle insert 112, which is threaded onto those distal internal threads 160. Additional aspects of the nozzle insert 112 are shown in FIGS. 7-9, with FIG. 7 showing a perspective view of the nozzle insert 112, FIG. 8 showing an end view thereof, and FIG. 9 showing a sectional view thereof along the cleave plane indicated in FIG. 8. The nozzle insert 112 is cylindrical with insert external threads 170. A hollow region 175 penetrates partially through the nozzle insert 112 along a central longitudinal insert axis 180 of the nozzle insert 112, and merges with a longitudinal pinhole 185 that penetrates the remainder of the nozzle insert 112 along the central longitudinal insert axis 180. The hollow region 175, which in the present embodiment is hexagonal, allows an Allen key or similar drive tool to be utilized to screw the nozzle insert 112 into the distal internal threads 160 of the nozzle 110 so that the insert external threads 170 threadably engage the distal internal threads 160. With the nozzle insert 112 fixedly inserted into the nozzle 110 in this manner, the central longitudinal nozzle axis 155 is collinear with the central longitudinal insert axis 180.

The air blow gun 105 may be attached to a source of high-pressure air (e.g., an air compressor) and the air blow gun 105 used to modulate the high-pressure air being delivered to the workpiece 10 through the nozzle 110 and nozzle insert 112. High-velocity air leaving through the six radial pinholes 145 of the nozzle 110 creates the six radial plumes 115. High-velocity air leaving through the longitudinal pinhole 185 of the nozzle insert 112 creates the longitudinal plume 120. The six radial plumes 115 and the longitudinal plume 120 exit the apparatus 100 at a higher velocity than the high-pressure air entering the nozzle 110. The relative dimensions of the six radial pinholes 145 and the longitudinal pinhole 185 may be adjusted to give the desired amount of air in each of the plumes 115, 120. In fact, the threaded attachment of the nozzle insert 112 to the nozzle 110 allows for the interchangeability of the nozzle insert 112. In one or more embodiments, as just one example, the six radial pinholes 145 may each have a diameter of about 0.050 inches, while the longitudinal pinhole 185 has a diameter of about 0.063 inches. Nevertheless, these dimensions are merely by way of example and are not intended to limit the scope of the invention. Alternative embodiments may also have fewer or greater than six radial pinholes.

Configured in the manner set forth above, the apparatus 100 provides an effective means by which to clean and dry confined spaces in workpieces. The apparatus 100 may, for example, be particularly well suited for cleaning head-bolt holes and manifolds in internal combustion engines. The apparatus 100 effectively provides 360-degrees of high-pressure air through the six radial pinholes 145 plus the addition of a longitudinal plume of high-pressure air through the longitudinal pinhole 185. Dirt and liquids are both dislodged and blown away from the workpiece 10 (see FIG. 2).

Air blow guns like the air blow gun 105 described herein are commercially available. The nozzle 110 and the nozzle insert 112 may be formed of metal (e.g., steel, aluminum, chrome) and may be manufactured utilizing conventional manufacturing techniques that will already be familiar to one having ordinary skill in the relevant manufacturing arts. Suitable forming techniques are also described in a number of readily available publications, including, for example, B. P. Bhardwaj, *Handbook on Steel Bars, Wires, Tubes, Pipes, S.S. Sheets Production with Ferrous Metal Casting & Processing*, Niir Project Consultancy Services, 2014, which is hereby incorporated by reference herein.

It should again be emphasized that the above-described embodiments of the invention are intended to be illustrative only. Other embodiments can use different types and arrangements of elements for implementing the described functionality. These numerous alternative embodiments within the scope of the appended claims will be apparent to one skilled in the art. The spirit and scope of the appended claims should not be limited solely to the description of the preferred embodiments contained herein.

Moreover, all the features disclosed herein may be replaced by alternative features serving the same, equivalent, or similar purposes, unless expressly stated otherwise. Thus, unless expressly stated otherwise, each feature disclosed is one example only of a generic series of equivalent or similar features.

What is claimed is:

1. An apparatus comprising:

a nozzle that is hollow cylindrical, centered about a central longitudinal nozzle axis, defines distal internal threads proximate to a distal end of the nozzle, and defines a plurality of radial pinholes proximate to the distal end and directed radially to the central longitudinal nozzle axis; and a nozzle insert that is cylindrical, centered about a central longitudinal insert axis, defines insert external threads, and defines a longitudinal pinhole along the central longitudinal insert axis;

wherein the nozzle insert is fixedly inserted into the distal end of the nozzle with the insert external threads threadably engaging the distal internal threads.

2. The apparatus of claim 1, wherein the nozzle further defines proximal external threads proximate to a proximal end of the nozzle.

3. The apparatus of claim 1, wherein the nozzle insert further defines a hollow region penetrating partially through the nozzle insert along the central longitudinal nozzle axis and merging with the longitudinal pinhole.

4. The apparatus of claim 3, wherein the hollow region is hexagonal.

5. The apparatus of claim 1, wherein each of the plurality of radial pinholes has a respective diameter different from that of the longitudinal pinhole.

6. The apparatus of claim 1, wherein the plurality of radial pinholes consists of six radial pinholes.

7. The apparatus of claim 1, wherein the central longitudinal nozzle axis is collinear with the central longitudinal insert axis.

8. An apparatus comprising:

an air blow gun;

a nozzle attached to the air blow gun, the nozzle being hollow cylindrical, centered about a central longitudinal nozzle axis, defining distal internal threads proximate to a distal end of the nozzle, and defining a plurality of radial pinholes proximate to the distal end and directed radially to the central longitudinal nozzle axis; and a nozzle insert that is cylindrical, centered about a central longitudinal insert axis, defines insert external threads, and defines a longitudinal pinhole along the central longitudinal insert axis;

wherein the nozzle insert is fixedly inserted into the distal end of the nozzle with the insert external threads threadably engaging the distal internal threads.

9. The apparatus of claim 8, wherein the nozzle further defines proximal external threads proximate to a proximal end of the nozzle.

10. The apparatus of claim 8, wherein the nozzle insert further defines a hollow region penetrating partially through the nozzle insert along the central longitudinal nozzle axis and merging with the longitudinal pinhole.

11. The apparatus of claim 10, wherein the hollow region is hexagonal.

12. The apparatus of claim 8, wherein each of the plurality of radial pinholes has a respective diameter different from that of the longitudinal pinhole.

13. The apparatus of claim 8, wherein the plurality of radial pinholes consists of six radial pinholes.

14. The apparatus of claim 8, wherein:

the air blow gun is attached to a source of high-pressure air; and the air blow gun is operative to modulate high-pressure air delivered to the nozzle and to the nozzle insert.

15. The apparatus of claim 14, wherein high-pressure air delivered to the nozzle and to the nozzle insert exits the apparatus as a plurality of radial plumes from the plurality of radial pinholes and as a longitudinal plume from the longitudinal pinhole.

16. The apparatus of claim 15, wherein the plurality of radial plumes exit the apparatus in a direction substantially normal to the direction that the longitudinal plume exits the apparatus.

17. The apparatus of claim 15, wherein the plurality of radial plumes and the longitudinal plume exit the apparatus at a higher velocity than high-pressure air entering the nozzle.

18. The apparatus of claim 14, wherein the air blow gun defines a lever operative to modulate high-pressure air delivered to the nozzle and to the nozzle insert.

19. The apparatus of claim 8, wherein the central longitudinal nozzle axis is collinear with the central longitudinal insert axis.

* * * * *